United States Patent [19]

Vos et al.

[11] 4,008,591

[45] Feb. 22, 1977

[54] DEVICE FOR ZIGZAG FOLDING OF STRIP MATERIAL

[75] Inventors: Leonardus Vos; Joannes Theodorus van der Sanden; Adrianus Johannes Van Mensvoort, all of Eindhoven, Netherlands

[73] Assignee: U.S. Philips Corporation, New York, N.Y.

[22] Filed: Aug. 25, 1975

[21] Appl. No.: 607,609

[30] Foreign Application Priority Data

Sept. 11, 1974 Netherlands ..... 7412054

[52] U.S. Cl. ..... 72/38; 72/385; 72/463

[51] Int. Cl.[2] ..... B21D 13/02

[58] Field of Search ..... 72/385, 386, 38, 463; 83/98, 99, 100

[56] References Cited

UNITED STATES PATENTS

| | | | |
|---|---|---|---|
| 3,172,321 | 3/1965 | Schrader | 83/100 |

FOREIGN PATENTS OR APPLICATIONS

| | | | |
|---|---|---|---|
| 639,168 | 4/1962 | Canada | 72/385 |
| 965,021 | 8/1950 | France | 72/385 |
| 37-2472 | 5/1962 | Japan | 72/385 |

*Primary Examiner*—Leon Gilden
*Attorney, Agent, or Firm*—Frank R. Trifari; David R. Treacy

[57] ABSTRACT

A device for zigzag folding of strip material and the like by means of two dies, the facing sides of which are provided with teeth. Each of the dies is provided with ducts which open into the toothed die face. During operation, the two duct systems are alternately connected to a source of a pressure, either higher or lower than atmospheric pressure, in order to keep the material alternately against one of the two toothed die faces during open die positions.

4 Claims, 7 Drawing Figures

DEVICE FOR ZIGZAG FOLDING OF STRIP MATERIAL

Figure 1:
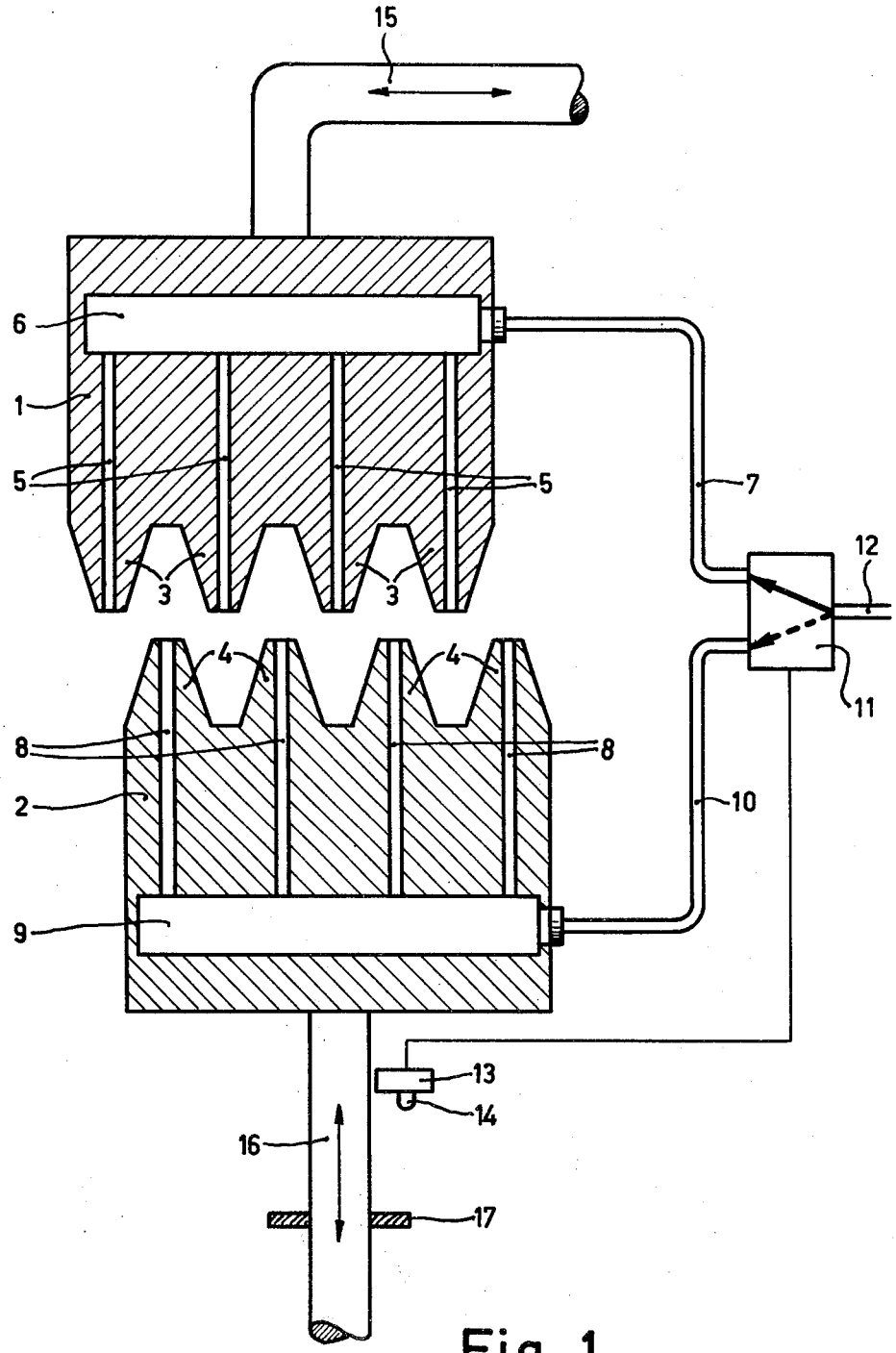

The invention relates to a device for zigzag folding of strip material or plate material and the like, hereinafter collectively referred to as strip material; and in particular to a device comprising two oppositely arranged dies, the facing faces of which are provided with a set of teeth, said dies being reciprocatable relative to each other in the axial direction, viewed in the direction from the one to the other set of teeth, and also in a transverse direction corresponding to the transport direction of the material between the dies, the dies being coupled to a drive which brings the dies, by relative axial movement, alternately to a closed position in which the sets of teeth engage each other and to an open position in which the sets of teeth are apart during operation; between successive closed positions the drive displacing the dies relatively transversely, alternately in opposite directions over a distance corresponding to the pitch of the teeth.

Devices of the kind set forth are known from British Patent specifications Nos. 584,575 and 608,775.

In the device known from the British Patent specification No. 584,575, the strip passed between the dies is maintained in a central position, at the same distance from the dies in the open position, by means of guide members located near the inlet and outlet side of the dies, the members being provided with narrow guide slots. The guide members also ensure that the strip remains in contact with the stationary die when the dies are opened.

Due to the presence of the guide members, the strip is subject to variable mechanical loads during the movements of the dies which, notably in the case of strip materials in the form of a thin foil (thicknesses of a few hundredths of a millimeter), gives rise to damage to and fracture of the foil.

The invention has for its object to provide an improved device, wherein in a structurally simple manner the strip is folded without the risk of damage.

The device according to the invention is characterized in that in each of the dies a system of ducts is provided, the ducts opening at one end into the die face provided with teeth and being connectable at the other end to a source of fluid pressure other than atmospheric pressure; and a control device is provided which, during successive open positions of the dies, keeps the two systems of ducts alternately in open communications with the source, for holding the material alternately against one of the two die faces under the influence of the pressure difference produced on both sides of the material.

It is thus achieved that over a comparatively large strip surface area a uniform pressure difference prevails on both sides of this surface, this difference remaining constant also during relative movement of the dies.

In a preferred embodiment of the device according to the invention, the source supplies a compressed fluid such as compressed air. In work-shops a compressed air duct is often already present. Instead of a gaseous medium, use can alternatively be made of a liquid such as water or oil.

In a further preferred embodiment of the device according to the invention, the source is formed by a vacuum pump system. A vacuum duct is also often one of the available facilities of a workshop.

A further preferred embodiment yet of the device according to the invention is characterized in that the control device comprises a switch which, when successive closed positions of the dies are reached, alternately brings a three-way valve member to a position in which one of the two duct systems is in open communication with the source.

The invention will be described in detail hereinafter with reference to the diagrammatic drawing which is not to scale.

FIG. 1 is a longitudinal sectional view of two cooperating dies of a device for zigzag folding of strip material, the said dies comprising a duct system which can be connected to a source of compressed air.

FIGS. 2*a* through 2*f* illustrate the sequential steps of operation of the device as shown in FIG. 1.

The references 1 and 2 in FIG. 1 denote two dies. The die 1 is provided with teeth 3, and the die 2 is provided with teeth 4. Inside the die 1 there are ducts 5 which at one end open into the end faces of the teeth 3 and at the other end into a central duct 6. The central duct 6 has connected thereto a flexible line 7. Similarly, the die 2 comprises ducts 8 which communicate, via a central duct 9 with a flexible line 10. The two flexible lines 7 and 10 are connected to the two outlets of a control device comprising a three-way valve 11, the common connection or inlet of which is connected to a compressed air line 12.

The ducts 5 and 6, and the ducts 8 and 9 each form a duct system, therefore, having respective ends 7 and 10.

The three-way valve 11 reacts to signals originating from a switch 13, comprising a push-button 14. In reaction to successive depression of the button 14, three-way valve 11 alternately releases the connection between the line 12 and the line 7 (uninterrupted arrow) and between the line 12 and the line 10 (broken arrow). The valve 11 may be, for example, a pressure-operated or electromagnetically operated slide.

The die 1 is reciprocatable only in the horizontal sense and is coupled, via a rod 15, to a drive mechanism not shown, whilst the die 2 is reciprocatable only in the vertical sense and is also coupled, via a rod 16, to a drive mechanism not shown. The dies can be driven, for example, mechanically, hydraulically or pneumatically. In the latter two cases this can be effected, for example, by means of a double-acting piston which is reciprocatable inside a cylinder and whose working surfaces are alternately subjected to high pressure and low pressure (see FIG. 2). The vertically reciprocatable rod 16 carries a flange 17 which, when the dies 2 and 1 reach the closed position in which the sets of teeth 3 and 4 engage, depresses the push-button 14, so that the switch 13 operates three-way valve 11, thus switching over this valve.

The operation of the device will now be described in detail with reference to FIG. 2 wherein, as has already been stated, the upper die moves only in the horizontal sense and the lower die moves only in the vertical sense.

The strip material which is supplied to the dies from the left is denoted by the reference 20 in FIG. 2.

Figure 2A:
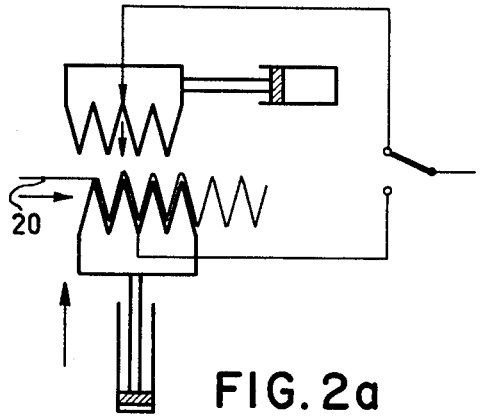
Figure 2B:
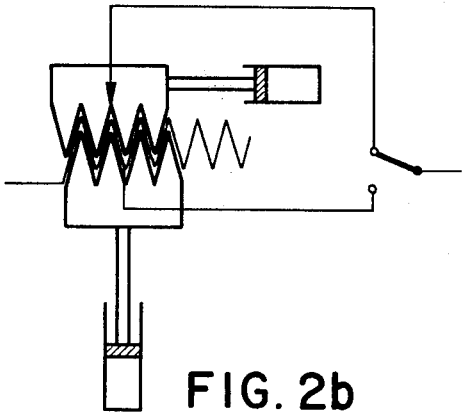
Figure 2C:
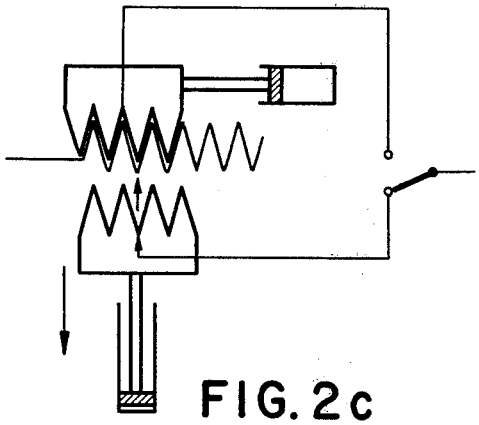
Figure 2D:
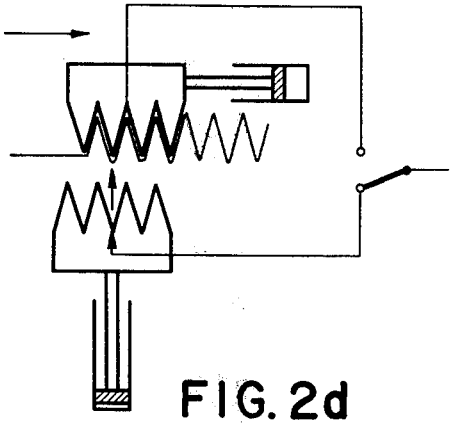
Figure 2E:
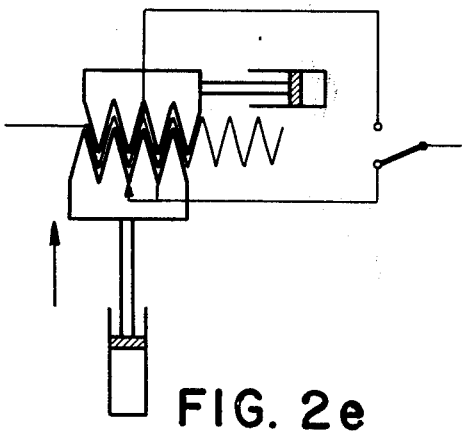
Figure 2F:
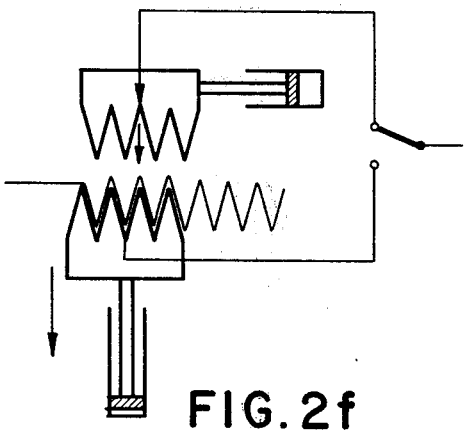

In FIG. 2*a* the upper die has reached the extreme left position and the lower die moves from its lower dead center in the direction of the upper die. The valve 11 occupies a position wherein compressed air line 12 is in open communication with the line 7, so that compressed air flows out of the teeth 3 via the ducts 5 in the upper die 1, the strip 20 thus being pressed against the lower die 2. When the lower die reaches the upper die, the strip is clamped between the dies (FIG. 2*b*) and a fold is made in the straight strip. Simultaneously (FIG. 1), the flange 17 presses the button 14 and the valve 11 is switched over, so that compressed air starts to flow from the teeth 4 of the lower die 2. During the movement of the lower die away from the upper die, the strip is thus pressed against the upper die (FIG. 2*c*). Subsequently, the upper die and the strip pressed thereagainst move to the right over one pitch distance (FIG. 2*d*), after which the lower die moves in the direction of the upper die and a second fold is made in the strip (FIG. 2*e*). Simultaneously, the flange 17 (FIG. 1) presses the button 14 again, so that the valve 11 is switched over again and compressed air is applied to the upper die. During the movement of the lower die away from the upper die, the strip is thus pressed against the lower die (FIG. 2*f*). The cycle is completed in that the upper die moves to the left again over the pitch distance, so that the starting situation shown in FIG. 2*a* is reached again. The compressed air suitably ensures that the strip (for example, a foil having a thickness of 0.02 mm) is each time held against one of the toothed die faces (during the folding and the transport of the strip), free from detrimental mechanical loads, and is subsequently released therefrom again.

The compressed air line 12 can be replaced by a vacuum line, if desired. However, the valve 11 should then be connected in a sense opposite to that shown in FIG. 2.

In FIG. 1 the ducts inside the dies open into the end faces of the teeth. Obviously, the ducts can also open between the teeth, whether or not in combination with the first possibility.

Although in the described embodiment only the upper die is transversally reciprocatable, it is of course also possible to make the two dies reciprocate simultaneously in the opposite sense in the transverse direction.

What is claimed is:

1. A device for zigzag folding of material, comprising two oppositely arranged dies having faces facing each other and a set of strip deforming teeth in each respective face; and means for reciprocatably moving said dies relative to each other in an axial direction, and in a direction transverse to said axial direction, such that the dies are moved axially alternately from a closed position in which said sets of teeth engage each other to an open position in which said sets of teeth are apart from each other, and are alternately displaced in opposite transverse directions over a distance corresponding to a pitch distance of the teeth;

wherein said device comprises means for providing a fluid pressure different from atmospheric pressure; a control device; and two duct systems, each opening at one end into a respective die face having teeth, and communicating at another end with said control device; said control device comprising means for alternately connecting one of said duct systems to said providing means during successive open positions of the dies, whereby material being folded is held alternately against one of the two die faces.

2. A device as claimed in claim 1 wherein said providing means supplies compressed air.

3. A device as claimed in claim 1 wherein said providing means comprises a vacuum source.

4. A device as claimed in claim 1 wherein said control means comprises a three-way valve having a common connection connected to said providing means, and outlet connections connected to said respective duct systems; and switch means responsive to said dies reaching a closed position for charging over said valve.

* * * * *